United States Patent [19]

Sigrist

[11] Patent Number: 4,723,490

[45] Date of Patent: Feb. 9, 1988

[54] BASE FUZE OF A SPINNING PROJECTILE POSSESSING AN INERTIA BODY

[75] Inventor: Hugo Sigrist, Hinwil, Switzerland

[73] Assignee: Werkzeugmaschinenfabrik Oerlikon-Bührle AG, Zürich, Switzerland

[21] Appl. No.: 946,958

[22] Filed: Dec. 29, 1986

[30] Foreign Application Priority Data

Jan. 14, 1986 [CH] Switzerland ..... 00111/86
Jul. 30, 1986 [CH] Switzerland ..... 03060/86

[51] Int. Cl.[4] ..... F42C 15/22

[52] U.S. Cl. ..... 102/243; 102/245; 102/273

[58] Field of Search ..... 102/237, 240, 243–245, 102/247, 273, 274, 221, 222

[56] References Cited

U.S. PATENT DOCUMENTS 3,022,733 2/1962 Junghans et al. ..... 102/240
3,995,557 12/1976 Engel et al. ..... 102/240 X
4,432,283 2/1984 Duffner ..... 102/240 X
4,440,085 4/1984 Rossmann et al. ..... 102/240 X
4,449,456 5/1984 Foss et al. ..... 102/240
4,458,594 7/1984 Weber et al. ..... 102/240

FOREIGN PATENT DOCUMENTS 2550093 5/1976 Fed. Rep. of Germany .

*Primary Examiner*—David H. Brown
*Attorney, Agent, or Firm*—Werner W. Kleeman

[57] ABSTRACT

The base fuze of a spinning projectile possesses a detonator capsule which is pierced by a firing pin. The firing pin is connected to a hammer sleeve. An inertia body is arranged behind the hammer sleeve in order to improve the response sensitivity of the base fuze. Upon impact of the projectile at the target, the inertia body, due to the inertia thereof, drives the firing pin conjointly with the hammer sleeve against the detonator capsule. This inertia body is subdivided into a number of sector-shaped portions which contain substantially cylindrical sections and truncated conical sections. A bore of a fuze housing within which the inertia body is arranged possesses a shoulder. This shoulder serves to support the truncated conical sections of the inertia body such that due to the spin of the projectile an axial force is produced which acts upon the inertia body causing it to impact against the hammer sleeve.

10 Claims, 3 Drawing Figures

BASE FUZE OF A SPINNING PROJECTILE POSSESSING AN INERTIA BODY

BACKGROUND OF THE INVENTION

The present invention broadly relates to munitions and, more specifically, relates to a new and improved construction of a base fuze for a spinning projectile.

Generally speaking, the base fuze of the present invention comprises a detonator capsule or cap and a firing pin for piercing or puncturing the detonator capsule or cap. A hammer sleeve is connected to the firing pin. Furthermore, there is provided an inertia body for increasing the response sensitivity of the base fuze. This inertia body is positioned rearwardly of or behind the hammer sleeve such that upon impact of the projectile at the target the inertia body bears directly against the hammer sleeve in order to increase the effect of the mass of the hammer sleeve during piercing of the detonator capsule or cap by the firing pin owing to the moment of inertia of the inertia body. A fuze housing possesses a bore therein and this bore has an inner wall. The inertia body is axially and radially movable within this bore. The inertia body and/or the inner wall of the bore possess a conical surface which opens or diverges in the direction of flight of the spinning projectile.

In Swiss Patent No. 585,891 and the cognate U.S. Pat. No. 3,995,557, granted Dec. 7, 1976, there is disclosed to the art a base fuze for spinning projectiles. Here, an inertia body is positioned behind a hammer sleeve which, upon impact of the projectile, directly bears against the hammer sleeve. This inertia body possesses two cylindrical sections of different diameter. These two cylindrical sections are interconnected with one another by a forwardly widening or increasing conical surface as seen in the firing direction of the projectile. Another embodiment of this base fuze employs an inertia body which is arranged within a bore of a fuze housing. This bore possesses two cylindrical sections of different diameter which are interconnected with one another by a forwardly widening conical surface as seen in the direction of the flight path or in the firing direction of the projectile.

This known base fuze is provided with a self-destruction spring which effectuates self-destruction of the projectile in the event the projectile fails to strike the target. To ensure that during the self-destruction no large mass need be accelerated in order to pierce or puncture the detonator capsule, the hammer sleeve together with the firing pin is fabricated as lightly as possible. Upon impact of the projectile at the target the firing pin together with the hammer sleeve, however, should be propelled as rapidly as possible against the detonator capsule and, for this reason, the inertia body is constructed as heavy as possible. The conical surface of the inertia body or of the bore in the fuze housing improves the response sensitivity of the fuze when impacting a target at a small or flat angle.

A disadvantage of this prior art base fuze resides in the fact that the required response sensitivity thereof is only ensured when the piercing or puncturing of the detonator capsule by means of the firing pin is augmented by the self-destruction spring.

A further prior art construction of base fuze for a spinning projectile is disclosed in U.S. Pat. No. 4,440,085, granted Apr. 3, 1984.

SUMMARY OF THE INVENTION

Therefore with the foregoing in mind it is a primary object of the present invention to provide a new and improved construction of a base fuze for a spinning projectile, especially a base fuze possessing an inertia body and which does not exhibit the aforementioned drawbacks and shortcomings of the prior art constructions.

Another and more specific object of the present invention aims at providing a new and improved construction of a base fuze of the previously mentioned type in which the response sensitivity of the base fuze is also ensured without the provision of a self-destruction spring and in which the base fuze response sensitivity is also then ensured when the projectile strikes or hits the target at a small or flat impact angle.

Yet a further significant object of the present invention aims at providing a new and improved construction of a base fuze of the character described which is relatively simple in construction and design, extremely economical to manufacture, and highly reliable in operation.

Now in order to implement these and still further objects of the present invention which will become more readily apparent as the description proceeds, the base fuze of the present invention is manifested by the features that the inertia body is subdivided into a number of sector-shaped portions or segments. These sector-shaped portions are radially movable away from one another due to the effect of the spin of the spinning projectile. These sector-shaped portions engage the inner wall of the housing bore such that the inertia body, under the influence of the projectile spin, axially impacts or strikes against the hammer sleeve.

Preferably, the inertia body comprises four 90°-sector-shaped portions or segments, and each such sector-shaped portion thus has two radii extending perpendicularly with respect to one another or enclosing an angle of 90°. Furthermore, the thus formed inertia body preferably has a substantially cylindrical section at the rear portion thereof and also the housing bore has a substantially cylindrical section at the rear portion thereof. The diameters of the cylindrical section of the inertia body and of the housing bore are essentially the same. Furthermore, the inertia body has a second substantially cylindrical section at the front portion thereof and also the bore may have a second cylindrical section at the front portion thereof. The diameter of these respective second cylindrical sections of the inertia body and the bore are essentially the same in the spread apart state of the sector-shaped portions, but the diameter of the first cylindrical section is smaller than the diameter of the second cylindrical section.

This construction of base fuze has the advantage that the forces acting upon the inertia body, due to the spin of the projectile, improve the response sensitivity of the base fuze.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
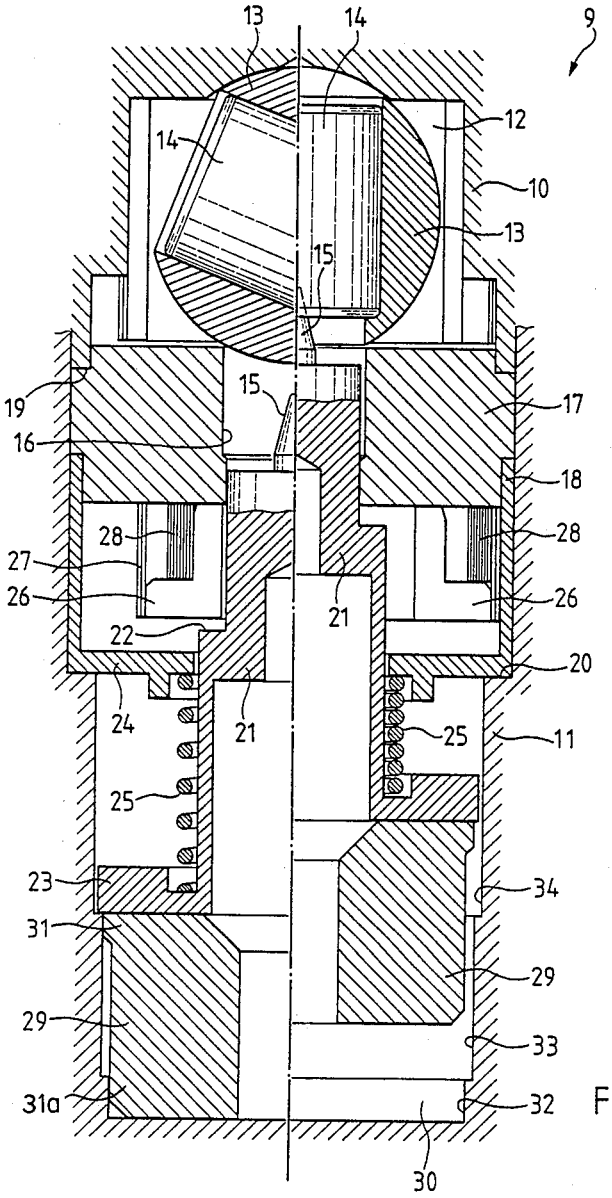
FIG. 1 PRIOR ART
FIG. 1 shows a longitudinal section through a prior art construction of base fuze for a spinning projectile without a self-destruction device.

Describing now the drawings, it is to be understood that to simplify the showing thereof only enough of the structure of the inventive base fuze of a spinning projectile has been illustrated therein as is needed to enable one skilled in the art to readily understand the underlying principles and concepts of the present invention. Turning now specifically to FIG. 1 of the drawings, the prior art construction of base fuze 9 for a spinning projectile as illustrated therein will be seen to show in its left-half and right-half two different fuze operating modes. The left-half shows the collective parts of the base fuze in their safety or de-armed position, whereas the right-half of FIG. 1 shows these same parts of the base fuze at the moment of piercing or puncturing the detonator capsule or cap by means of the firing pin.

FIG. 1 explicitly shows a base fuze 9 having a housing front portion 10 and a housing rear portion 11 which are, however, only partially depicted to simplify the drawings. These housing portions 10 and 11 are connected to one another in any suitable manner as is well known. The housing front portion 10 possesses a substantially cylindrical bore 12 in which there is arranged a substantially spherical-shaped rotor or disc-shaped rotor 13. This rotor 13 contains a detonator capsule or cap 14 which can be appropriately pierced or punctured by means of a firing pin or ignition pin 15. This firing pin 15 is movably guided in a bore 16 provided in a guide disc or plate 17. This guide disc or plate 17 is fixedly positioned between a shoulder 19 provided in the housing front portion 10 and a sleeve or bushing 18 supported by a shoulder 20 provided in the housing rear portion 11. The firing pin 15 is connected with a hammer or striker sleeve 21 or equivalent structure, the middle or intermediate portion of which is provided with a shoulder 22 and the rear portion of which possesses a guide disc 23. The afore-mentioned sleeve or bushing 18, which is fixedly anchored in the housing rear portion 11, possesses a bottom portion 24.

A holder or positioning spring 25 engages at its one end with the bottom portion 24 and at its other end with the guide disc 23 of the hammer sleeve 21 and strives to move the hammer sleeve 21 rearwardly, i.e. to move the firing pin 15 away from the detonator capsule or cap 14. The interior of the sleeve or bushing 18 contains a number of locking or blocking bodies 26 which can but need not necessarily bear against the shoulder 22 of the hammer sleeve 21 and also against the fixed guide plate 17. In the illustration shown in the left-half of FIG. 1 the locking or blocking bodies 26 are shown only bearing against the fixed guide plate 17 and are held in spaced relationship from the shoulder 22 owing to the action of a resilient ring or ring-shaped spring 27 and its centrifugal force band or band member 28. These locking or blocking bodies 26 serve to prevent a premature piercing or puncturing of the detonator capsule or cap 14 by the firing pin 15.

As noted above, these locking or blocking bodies 26 are held together, on the one hand, by means of the resilient ring or ring-shaped spring 27 and, on the other hand, by means of the centrifugal force band or band member 28. Rearwardly of the guide disc 23 of the hammer sleeve 21 there is provided a substantially cylindrical inertia body 29 located within a bore 30 of the housing rear portion 11. A front portion 31 of this inertia body 29 has a larger diameter than the remaining portion 31*a*. The stepped bore 30 possesses three sections 32, 33 and 34 each of different diameter. In this way the inertia body 29, as can be seen in the left-half of FIG. 1, is secured against radial movement and possesses, as illustrated in the right-half of FIG. 1, a small radial play.

Figure 2:
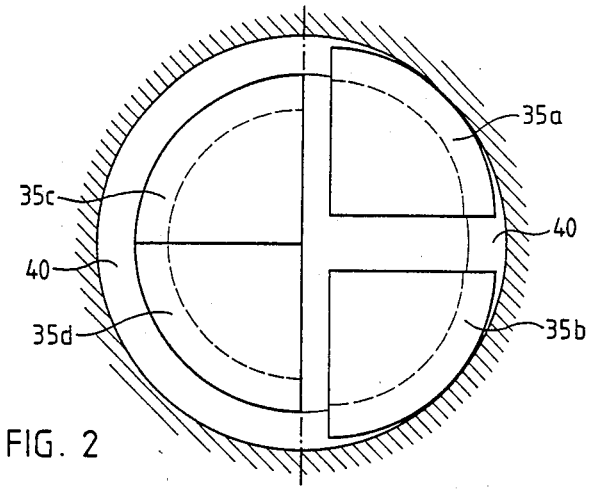
FIG. 2 shows a cross-section through a base fuze constructed according to the present invention and substantially taken along the line A—A in FIG. 3.
Figure 3:
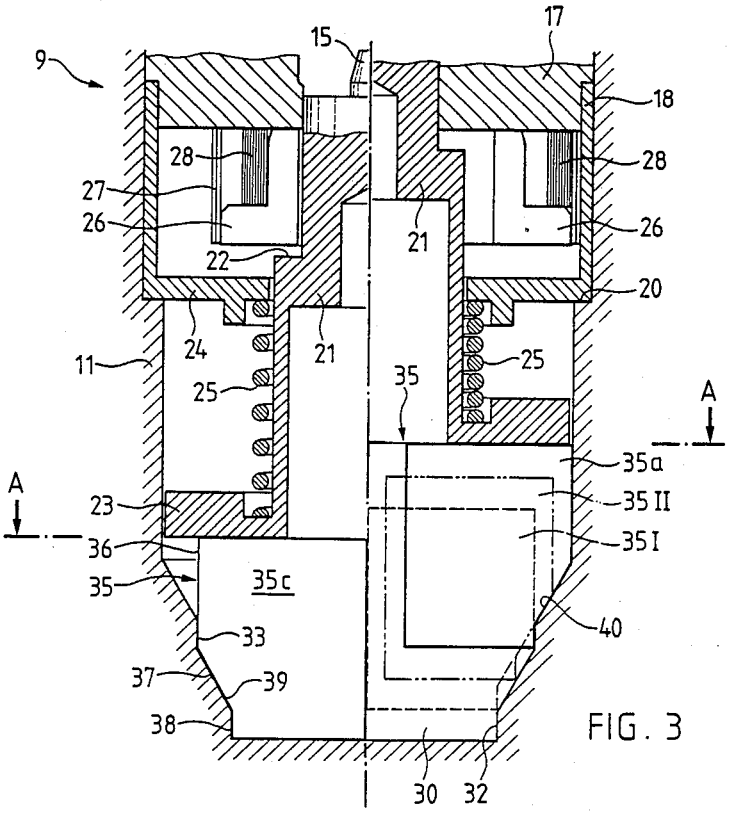
FIG. 3 shows a longitudinal section, partially in side view, of a base fuze equipped with the inventive inertia body.

The base fuze as illustrated in FIGS. 2 and 3 distinguishes itself from the just-described base fuze explained with reference to FIG. 1 by the provision of a different inertia body or inertia means 35. This inertia body 35 comprises a substantially cylindrical section 36 at the front portion thereof, a truncated conical middle or intermediate section 37 and a substantially cylindrical section 38 at the rear portion of the inertia body 35. The inertia body 35 is subdivided into four 90°-sector-shaped portions 35*a*, 35*b*, 35*c* and 35*d* as is particularly clearly shown in FIG. 2. In FIG. 3 there are shown four different positions of the inertia body 35. In the left-half of FIG. 3 the inertia body 35 is shown in full lines in its rearmost position, whereas in the right-half of FIG. 3 it is shown in full lines in its frontmost position. Additionally, in the right-half of FIG. 3 two intermediate positions 35I and 35II are indicated.

This inertia body 35 is positioned in a bore 30 of the fuze housing composed of the afore-described housing parts or portions 10, 11 discussed with reference to FIG. 1. This bore 30 has a rearward or rear substantially cylindrical section 32 provided with a smaller diameter and a forward substantially cylindrical section 33 of larger diameter as seen in the firing direction or direction of flight of the spinning projectile. These cylindrical sections or portions 32 and 33 are interconnected with one another by a conical surface 39. Furthermore, the bore 30 possesses a substantially conical shoulder 40 which is provided for the purpose of supporting the truncated conical middle or intermediate section 37 of the inertia body 35.

Figure 4:
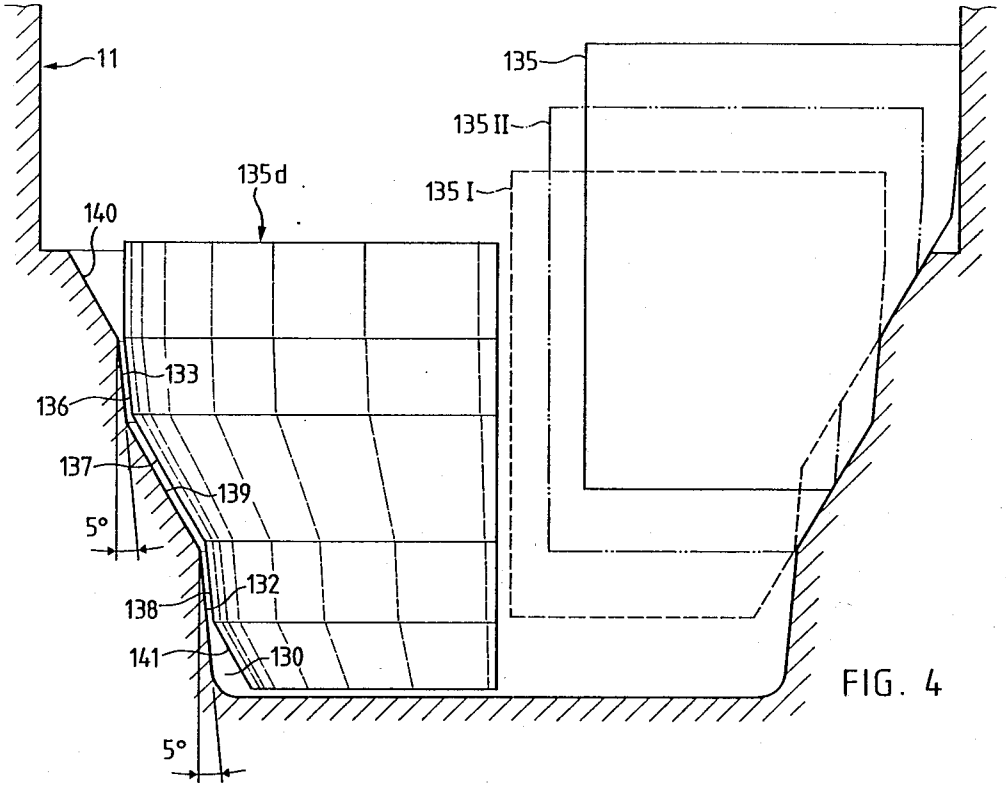
FIG. 4 shows to a larger scale a fragmentary longitudinal partial sectional view of an other embodiment of the inventive base fuze in an illustration corresponding to the showing depicted in FIG. 3 and particularly illustrating details of the inertia body.

Attention is now directed to FIG. 4 where the modified construction of base fuze illustrated therein differs from the base fuze as illustrated in FIG. 1 by the provision of a still different inertia body or inertia means 135. This inertia body or inertia means 135 comprises a front section 136 which is of conical shape and possessing a relatively small or slight taper angle, a middle or intermediate section 137 which is truncated-conically-shaped, a third section 138 which is conically-shaped with a relatively small or slight taper angle and a rear section 141 which is truncated-conically-shaped. The inertia body 135 is subdivided into four 90°-sector-shaped portions comparable to the 90°-sector-shaped portions 35*a*, 35*b*, 35*c* and 35*d* described previously with reference FIG. 2. Four different positions of the inertia body 135 are shown in FIG. 4. On the left-hand side of FIG. 4 the inertia body 135 is depicted in its almost rearmost position in solid lines and on the right-hand side of FIG. 4 the inertia body 135 is shown in its frontmost position in solid lines. Additionally, on the right-half side of FIG. 4 two further intermediate positions of the inertia body 135 are indicated by reference characters 135I and 135II. This inertia body 135 is positioned in a bore 130 of the fuze housing again composed of the fuze housing parts or portions 10, 11 previously considered with reference to FIG. 1. This bore 130 has a rearmost or rear section 132 which is conically formed with a relatively small or slight taper angle and has a smaller diameter. This bore 130 further possesses a section 133 of a substantially conical configuration provided with a relatively small or slight taper angle but having a larger diameter. The sections 132 and 133 are interconnected with one another by a substantially conical surface 139. Also, the bore 130 is provided with a conical shoulder 140 serving to support the truncated conical section 137 of the inertia body 135 when under the influence of the spin of the spinning projectile. The relatively slight taper angle of the various slightly tapered parts or sections discussed previously with reference to the embodiment of FIG. 4 may be, for instance, in the order of about 5° with respect to the vertical as indicated in such Figure. The relatively large angled conical sections may, by way of example and not limitation, have an angle of inclination with respect to the vertical of approximately 30°.

It will thus be appreciated that in the embodiment of FIG. 4 the inertia body 135 and the bore 130 each have two relatively small angled conical sections 138, 136 and 132, 133, respectively, and two relatively large angled conical sections 141, 137 and 139, 140 respectively. The relatively small angled conical sections and the relatively large angled conical sections are alternatively arranged such that, seen in the firing direction of the projectile, one of the relatively small angled conical sections is followed by one of the relatively large angled conical sections.

The mode of operation of the aforedescribed base fuze of the spinning projectile is now described and is as follows:

Upon firing of the spinning projectile equipped with the inventive base fuze 9 all of the parts of the base fuze are in the position as shown on the left-hand side of FIG. 3. Upon firing of the spinning projectile the firing pin 15, conjointly with the hammer sleeve 21 and the inertia body 35, are pressed rearwardly under the influence of the firing acceleration, i.e. they remain in their initial position. Due to the spinning of the projectile the centrifugal force band 28 is unwound and the resilient ring or ring-shaped spring 27 is enlarged as illustrated in FIG. 3 at the right-hand side. Now, the locking or blocking bodies 26 can radially move outwardly thereby effectively releasing the hammer sleeve 21. The deceleration of the spinning projectile, due to the air resistance, is so small or negligible that the holder or positioning spring 25 is able to retain the hammer sleeve 21 and the inertia body 35 in their rearmost or rear position. Since the rearmost or rear cylindrical section 38 of the inertia body 35 is positioned in the rearmost or rear cylindrical section 32 of the bore 30, the four sector-shaped portions **35*a* to 35*d* of the inertia body 35 are kept together and cannot diverge or move away from one another under the action of the spin of the spinning projectile. Only the deceleration of the spinning projectile upon impact thereof at the target causes the inertia body 35 to be moved out of the rearmost or rear cylindrical section 32 against the holding or positioning force of the holder or positioning spring 25 and only then the four 90°-sector-shaped portions 35*a* to 35*d* are able to diverge or move away from one another in radial direction. During this radial movement the sector-shaped portions 35*a* to 35*d* slide along the conical surface or section 39 and along the conical shoulder 40 in a forward direction as depicted in the right-half of FIG. 3. In this manner the hammer sleeve 21, conjointly with the firing pin 15, is pushed or driven against the detonator capsule or cap 14** under the action of the spin of the spinning projectile. In this way the deceleration force upon impact of the spinning projectile at the target is augmented by the spinning forces.

The mode of operation of the second embodiment of base fuze as depicted in FIG. 4 is essentially as just described. However, by virtue of the slightly tapered conical surfaces 133, 136 and 132 and 138 according to this second embodiment of base fuze as illustrated in FIG. 4 it is ensured that the four sector-shaped portions **35*a*, 35*b*, 35*c* and 35*d* do not remain under the action of the projectile spin in their rearmost position and press so hard against the wall of the bore that, upon impact of the spinning projectile at a target, there is permitted the required axial movement of these sector-shaped portions 35*a* to 35*d* necessary to pierce or puncture the detonator capsule or cap 14 by means of the firing pin 15**.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A base fuze for a spinning projectile having a firing direction, comprising:

a detonator capsule;

a firing pin for piercing said detonator capsule;

a hammer sleeve operatively connected to said firing pin;

an inertia body for increasing the response sensitivity of the base fuze;

said inertia body being positioned rearwardly with respect to the firing direction of the projectile behind said hammer sleeve such that upon impact of the projectile at the target said inertia body directly bears against said hammer sleeve in order to increase the effect of the mass of said hammer sleeve during piercing of said detonator capsule by means of said firing pin by virtue of the moment of inertia of said inertia body;

a fuze housing possessing a bore therein;

said bore possessing an inner wall;

said inertia body being axially and radially movable within said bore;

said base fuze being provided with at least one forwardly enlarging conical surface disposed within said fuze housing;

said inertia body being subdivided into a number of sector-shaped portions; and said number of sector-shaped portions being radially movable away from one another due to the effect of the spin of the projectile, thereby engaging said inner wall of said bore such that such inertia body, under the influence of the projectile spin, axially impacts against said hammer sleeve.

2. The base fuze as defined in claim 1, wherein:

said at least one forwardly enlarging conical surface being provided at least at said inertia body.

3. The base fuze as defined in claim 1, wherein:

said at least one forwardly enlarging conical surface being provided at least at said inner wall of said bore.

4. The base fuze as defined in claim 1, wherein:

said at least one forwardly enlarging conical surface being provided at both said inertia body and said inner wall of said bore.

5. The base fuze as defined in claim 1, further comprising:

a further forwardly enlarging conical surface disposed within said fuze housing; and said further forwardly enlarging conical surface being provided at said inner wall of said bore.

6. The base fuze as defined in claim 1, wherein:

said number of sector-shaped portions comprising four sector-shaped portions; and each of said four sector-shaped portions defining a substantially 90°-sector-shaped portion.

7. The base fuze as defined in claim 1, wherein:

said inertia body and said bore each have two relatively small angled conical sections and two relatively large angled conical sections; and said relatively small angled conical sections and said relatively large angled conical sections being alternatively arranged such that, seen in the firing direction of the projectile, one of said relatively small angled conical sections is followed by one of said relatively large angled conical sections.

8. The base fuze as defined in claim 1, wherein:

said inertia body possessing a front portion and a rear portion;

said inertia body possessing a substantially cylindrical section at the rear portion thereof;

said bore possessing a front portion and a rear portion;

said bore possessing a substantially cylindrical section at the rear portion thereof; and said substantially cylindrical section of said inertia body and said substantially cylindrical section of said bore having essentially the same diameter.

9. The base fuze as defined in claim 8, wherein:

said inertia body possessing a further cylindrical section at the front portion thereof;

said bore possessing a further cylindrical section at the front portion thereof;

said further cylindrical section of said inertia body and said further cylindrical section of said bore having essentially the same diameter in the moved away position of the sector-shaped portions; and said cylindrical section of said inertia body being smaller in diameter than said further cylindrical section of said inertia body.

10. A base fuze for a spinning projectile, comprising:

a detonator capsule;

a firing pin for piercing said detonator capsule;

a hammer sleeve operatively connected to said firing pin;

an inertia body cooperating with said hammer sleeve and serving for increasing the response sensitivity of the base fuze;

said inertia body being positioned behind said hammer sleeve such that upon impact of the projectile at the target said inertia body bears against said hammer sleeve in order to increase the effect of the mass of said hammer sleeve during piercing of said detonator capsule by means of said firing pin by virtue of the moment of inertia of said inertia body;

a fuze housing possessing a bore therein;

said bore possessing an inner wall;

said inertia body being axially and radially movable within said bore;

said inertia body being subdivided into a number of sector-shaped portions; and said number of sector-shaped portions being radially movable away from one another due to the effect of the spin of the projectile, thereby engaging said inner wall of said bore such that such inertia body, under the influence of the projectile spin, axially impacts against said hammer sleeve.

* * * * *